United States Patent [19]

Oschatz

[11] 4,314,819

[45] Feb. 9, 1982

[54] FIXATION OF REACTIVE DYES ON CELLULOSIC FIBERS

[75] Inventor: Christian Oschatz, Schallbach, Fed. Rep. of Germany

[73] Assignee: Sandoz Ltd., Basel, Switzerland

[21] Appl. No.: 946,476

[22] Filed: Sep. 28, 1978

[30] Foreign Application Priority Data

Sep. 29, 1977 [CH] Switzerland ..... 11913/77

[51] Int. Cl.[3] ..... D06P 1/38; D06P 1/673

[52] U.S. Cl. ..... 8/630; 8/632

[58] Field of Search ..... 8/54.2, 82, 163, 1 J, 8/1 K, 1 L, 630, 632

[56] References Cited

U.S. PATENT DOCUMENTS

| | | | |
|---|---|---|---|
| 2,892,671 | 6/1959 | Alsberg et al. | 8/163 X |
| 3,202,650 | 8/1965 | Steinemann | 8/54.2 X |
| 3,282,846 | 11/1966 | Scott | 252/75 |
| 3,334,961 | 8/1967 | Kühne et al. | 8/54.2 |
| 3,416,878 | 12/1968 | Biber | 8/54.2 |
| 3,418,308 | 12/1968 | Icher et al. | 8/12 X |
| 3,498,736 | 3/1970 | Freyermuth et al. | 8/630 |
| 3,545,910 | 12/1970 | Ong | 8/163 X |
| 3,617,169 | 11/1971 | Schulz | 8/163 X |
| 3,649,161 | 3/1972 | Von der Eltz | 8/630 |
| 3,843,318 | 10/1974 | Von der Eltz | 8/82 X |
| 4,092,101 | 5/1978 | Dillmann | 8/541 |
| 4,149,985 | 4/1979 | Wilson | 252/74 |
| 4,171,986 | 10/1979 | Freyhold et al. | 106/74 |

FOREIGN PATENT DOCUMENTS

| | | | |
|---|---|---|---|
| 50-121583 | 9/1975 | Japan | 8/632 |
| 1398398 | 6/1975 | United Kingdom . | |

OTHER PUBLICATIONS

Chem. Abstract, vol. 81: 122495h, 1974.
Chem. Abstract, vol. 91: 186027w, 1979.
Chem. Abstract, vol. 89: 134246f, 1978.
A. J. Hall, *Textile World,* Aug. 1964, pp. 82–88.

*Primary Examiner*—Maria Parrish Tungol
*Attorney, Agent, or Firm*—Gerald D. Sharkin; Richard E. Vila; Thomas C. Doyle

[57] ABSTRACT

A process for dyeing or printing with reactive dyestuffs a substrate consisting of or comprising cellulosic fibres, comprises using for the fixation of the reactive dyestuffs an aqueous solution of an alkaline system at a pH of from 9 to 13 comprising (a) an alkali metal silicate, and (b) an alkali metal borate, and optionally (c) an alkali metal bicarbonate and/or (d) an alkali metal carbonate.

20 Claims, No Drawings

FIXATION OF REACTIVE DYES ON CELLULOSIC FIBERS

The present invention relates to a process for dyeing or printing a substrate consisting of or comprising cellulosic fibres with reactive dyestuffs.

The present invention provides a process for dyeing or printing with reactive dyestuffs a substrate consisting of or comprising cellulosic fibres, which process comprises using for the fixation of the reactive dyestuffs an aqueous solution of an alkaline system at a pH of from 9to 13 comprising (a) an alkali metal silicate, and (b) an alkali metal borate, and optionally (c) an alkali metal bicarbonate, and/or (d) an alkali metal carbonate.

In the alkaline system, when component (c) is absent, component (d) may be present but is preferably also absent. A preferred alkaline system used according to the invention is a mixture comprising components (a), (b) and (c).

The alkali metal salts present in the alkaline system are preferably sodium or potassium salts, more preferably sodium salts. Alkali metal borate is preferably borax, i.e. $Na_2B_4O_7$, $1OH_2O$.

Suitable alkali metal silicates (generally named as waterglasses) are sodium silicates (soda waterglasses) having a $Na_2O:SiO_2$ weight ratio of from 1:1.5 to 1:3, preferably of from 1:2 to 1:3, more preferably of from 1:2.3 to 1:2.8. The preferred soda waterglasses are those of 30°-60° Bé, more preferably of 30°-45° Bé and most preferably of 34°-38° Bé.

In the alkaline system used according to the invention, the dry weight ratio of sodium silicate to sodium borate (calculated as borax, i.e. sodium tetraborate decahydrate) is suitable from 1100:1 to 1:4 [e.g. for every 10-200 g of sodium waterglass of 30°-60° Bé (25-55% dry weight) there is employed 0.1-10 g of borax]. Preferably, the dry weight ratio is from 110:1 to 4:1 [e.g. 50-120 g of sodium waterglass of 30°-45° Bé (25-45% dry weight) to 0.5-3 g of borax]. More preferably, it is from 68:1 to 18:1 [e.g. 90-110 g of sodium water-glass of 34°-38° Bé (30-33.5% dry weight) to 0.5-1.5 g of borax].

According to the process of the invention the alkaline system can be added to a dyeing liquor or a printing paste containing one or more reactive dyestuffs or can constitute a fixing liquor, depending on the dyeing or printing process used. Such aqueous dyeing or fixing liquors and printing pastes containing the alkaline system form a further feature of the invention.

Dyeing or fixing liquors and printing pastes contain suitably from 2.5 to 110 g/l, preferably from 12.5 to 54 g/l and most preferably from 27 to 34 g/l of alkali metal silicate, the preferred alkali metal silicate being, as indicated above, sodium silicate and especially soda waterglass. The above concentrations of alkali metal silicate are suitably provided by employing 10-200 g/l of soda waterglass of 30° to 60° Bé, 50-120 g/l of soda waterglass of 30° to 45° Bé or 90-110 g/l of soda waterglass of 34° to 38° Bé.

The concentration of component (b) in the dyeing or fixing liquor or printing paste is suitably from 0.1 to 10 g/l. Preferably, such liquor or paste contains component (b) in an amount of from 0.5 to 3 g/l, more preferably of from 0.05 to 1.5 g/l. Again, as indicated above the preferred component (b) is borax.

The concentration of component (c), particularly of sodium bicarbonate, in the liquor or paste of the invention is suitably from 0 to 100 g/l, preferably from 1 to 50 g/l, more preferably from 5 to 15 g/l.

The concentration of component (d), particularly of sodium carbonate, in the dyeing or fixing liquor or the printing paste is suitably from 0 to 100 g/l, preferably from 0 to 50 g/l, more preferably from 0 to 15 g/l.

The dyeing or fixing liquors and the printing pastes of the invention have a pH value preferably ranging from 10 to 13, more preferably from 10 to 12.7, most preferably from 10.8 to 12.2, particularly from 10.9 to 11.3. In addition to the dyestuffs and the alkaline system, the dyeing liquor and the printing paste may contain the usual additives such as dispersing agents, thickening agents, urea etc, in the presence or absence of polyglycols. Fixing liquors may contain, in addition to the alkaline system, additives such as sodium sulfate, sodium chloride, weak oxidizing agents, e.g. sodium nitrobenzenesulphonate, etc.

The process of the invention is suitable for dyeing or printing cellulosic fibres, for example natural or regenerated cellulose, e.g. cotton or rayon staple fibre, corresponding fibre mixtures and blends made from the materials mentioned above and synthetic fibrous materials such as polyester fibres. The substrate may be in any conventional form, e.g. woven or knitted, fabrics, nonwovens, carpets, tops or sheets.

The reactive dyes used in the process according to the invention may, in principle, be any water soluble reactive dye which contains at least one fibre reactive group and include reactive dyes of the azo (monoazo, polyazo and metalazo)-, anthraquinone-, formazane-, triphenyldioxazine-, nitro-, and phthalocyanine series having at least one fibre reactive group. Examples of suitable dyes are those having at least one reactive group selected from vinylsulphonyl, sulphatoethylsulphonyl, sulphatoethylsulphonamido, thiosulphatoethylsulphonamido, sulphatoethylsulphonacrylamido, methyltaurinoethylsulphonyl, acrylamido, α-haloacrylamido, chloropropylamido, sulphatopropylamido, haloaceticacidamido, mono- and di-halo-1,3,5-triazinyl, trichloropyrimidinyl, mono-chlorodifluoropyrimidinyl, methylsulphonylchloromethyl-pyrimidinyl, dichloroquinoxalinyl, dichlorophtalazinyl, benzochlorothiazolyl, dichloropyridazonyl and dichloropyrazinyl radicals. Also suitable are dyes having reactive groups derived from halocarboxylic acids, especially chloroacetyl, β-chlororpropionyl, α,β-dibromopropionyl and α,β-dichloropropionyl radicals.

Preferred reactive dyestuffs are the cold reactive dyes containing at least one reactive group selected from mono- and di-halo-1,3,5-triazinyl, trichloropyrimidinyl and mono-chlorodifluoropyrimidinyl radicals. Dyestuffs of this type are known from the Colour Index; as examples of such dyes may be given C.I. Reactive Yellow 83, Reactive Yellow 131, Reactive Yellow 125, Reactive Orange 71, Reactive Orange 69, Reactive Orange 64, Reactive Red 118, Reactive Red 123, Reactive Red 119, Reactive Red 147, Reactive Red 159, Reactive Violet 33, Reactive Blue 166, Reactive Blue 114, Reactive Blue 104, Reactive Blue 178, Reactive Blue 113, Reactive Blue 116, Reactive Blue 169.

The alkaline system can be used in any dyeing or printing process where an alkaline medium, i.e. of a pH from 9-13, is required for the fixation of the reactive dyestuffs. As examples of such processes may by given continuous dyeing processes such as pad-steam, pad-thermofixation, pad-batch or pad-sky processes, printing processes such as print-steam, print-thermofixation or dwell-print processes, or exhaust dyeing processes.

Pad-steam and print-steam processes may be carried out in one step (all-in-process), i.e. the substrate is padded or printed with, respectively, a dyeing liquor or printing paste containing the reactive dyestuff in admixture with the alkaline system, and then subjected to fixation. These dyeing and printing processes can also be carried out by the two-step method. In this case, the substrate is padded or printed with a liquor or a paste of the reactive dyestuff, optionally dried, subsequently impregnated at a temperature up to 80° C. with a fixing liquor containing the alkaline system, and then submitted to fixation. The intermediate drying of the dyed or printed substrate may be effected by known methods, for example through infra-red irradiation or with convection or contact dryers, at a temperature up to 130° C. The subsequent fixation of the reactive dyestuffs may be carried out in both cases by steaming the substrate, e.g. with steam of from 100° to 105° C. under normal pressure or with saturated steam of from 100° to 150° C. under pressure. Fixation time may vary in the range of from 1 second to 30 minutes.

In the Pad- or Print-thermofixation processes, dyeing or printing can also be effected in one or two steps, with optionally an intermediate drying in the case of the two-stage process. Subsequent thermofixation may be carried out by a heat treatment with hot air or superheated steam at a temperature of from 100° to 230° C. for a period of from 1 second to 30 minutes.

In the case of Print-steam or Print-thermofixation, it is also possible first to impregnate the substrate with a liquor containing the alkaline system and then to apply the printing paste which contains the reactive dyestuff to the substrate. The dyestuff is fixed by a heat treatment as stated above.

As mentioned above, the process of the invention can also be used in the case of exhaust dyeing with short to long bath, the liquor to goods ratio being in the range of from 2:1 to 50:1. Dyeing can be carried out in winch becks, paddle dyeing machines, jiggers etc. by the all-in or gradual dosing process.

The process of the invention is particularly appropriate for the warm or cold pad-batch or dwell-print process. In the case of the one-stage process, the substrate is padded or printed at a temperature of from 5° to 40° C. with a dyeing liquor or printing paste containing the reactive dyestuff and the alkaline system. Subsequent fixation is carried out at a temperature of from 5° to 150° C. and optionally under a steam atmosphere for a period of from 30 seconds to 48 hours.

More preferably, the process of the invention is carried out by the one-step or two-step cold pad-batch or cold dwell-print method using reactive dyestuffs. In the one-step process, the substrate is padded or printed wth a dyeing liquor or a printing paste containing the reactive dyestuff and the alkaline system; subsequent fixation of the reactive dyestuff is carried out by storing the impregnated or printed substrate for 2 to 24 hours at a temperature of from 5° to 40° C. In the two-step process, after being padded or printed with a liquor or a paste containing the reactive dye, the substrate is subjected to an alkaline shock. In this process, the padded or printed substrate, after an optional drying at a temperature of from 100° to 130° C., is immersed in a fixing liquor containing the alkaline system at a temperature of from 60° to 100° C., preferably of from 85° to 100° C., and for a period of from 1 to 20 seconds. Subsequent fixation of the reactive dyestuff is effected by storing the substrate for 2 to 24 hours at a temperature of from 5° to 40° C. The process of the invention is preferably carried out by the one-step cold pad-batch or cold dwell-print method.

The process of the invention is particularly suitable in one-step dyeing or printing processes using reactive dyestuffs, the dyeing liquors and printing pastes containing the reactive dyestuffs in admixture with the alkaline system being significantly more stable than those hitherto known. Thus they can be stored for up to 10 hours at a temperature of from 0° to 40° C. The alkaline system according to the present invention displays a buffering action and a lower alkalinity than conventional alkaline agents such as sodium hydroxide at 36° Bé, and therefore the reactive dyestuffs are hydrolysed only very slowly or not at all. The alkaline system enhances the reactivity of the dyestuffs and thus allows the fixation time to be reduced. The process of the invention gives significantly higher fixation yields compared with conventional processes, and the appearance of the dyed or printed goods is not altered. Another advantageous feature is improved safety, the alkaline system of the invention being less dangerous to handle than for example a concentrated sodium hydroxide solution.

By the process of the invention, dyeings and printings with generally good properties are obtained.

The alkaline system forms a further aspect of the invention. It can be prepared in solid form in which case this composition comprises only components (a) and (b), the dry weight ratio of silicate to borate being in the range stated above. Before use, this solid alkaline composition is dissolved in water, for example at 100° C.; if desired, components (c) and (d) can be added after cooling and the mixture then diluted to the correct proportions.

The alkaline composition according to the invention can also be prepared in form of an aqueous concentrate. This concentrate may, like the solid form, contain in addition to water only the alkali metal silicate and borate; the concentration of alkali metal silicate and alkali metal borate is suitably from 25 to 56%, preferably from 25 to 50%, more preferably from 30 to 37,5% by weight, the dry weight ratio and preferred dry weight ratios of alkali metal silicate to alkali metal borate being as stated above. This aqueous concentrate can be diluted to the appropriate proportions and optionally components (c) and (d) can be added in order to obtain the dyeing or fixing liquor or printing paste employed in the process of the invention.

The alkaline composition according to the invention may also be in a dilute liquid form, which form may comprise components (a) and (b) and optionally (c) and/or (d) as stated above, the dry weight ratio of alkali metal silicate to alkali metal borate being as specified.

As a preferred dilute liquid form of the composition according to the invention may be given an aqueous solution containing from 3 to 12%, preferably 5 to 10%, more preferably from 7 to 10% of alkali metal silicate (dry weight) from 0.15% to 1%, preferably 0.2 to 0.5% and more preferably 0.2 to 0.4% of alkali metal borate (dry weight), from 0 to 4%, preferably 0.5 to 4% and more preferably from 1.5 to 3% of alkali metal bicarbonate (dry weight) and 0 to 4%, preferably 0 to 3% by weight of alkali metal carbonate.

The following Examples further serve to illustrate the invention. In the Examples all temperatures are in degrees Centigrade.

EXAMPLE 1

A mercerized bleached cotton sateen is padded for 3 hours with a dye bath containing 25 g/l of C.I. Reactive Brilliant Red 147

100 g/l of sodium waterglass of 36° Bé, having a $Na_2O:SiO_2$ weight ratio of 1:2.5

1 g/l of borax, and 10 g/l of sodium bicarbonate and then is squeezed to 70% residual moisture. The resulting substrate is stored at 25° for 4 hours. An even brilliant red shade is obtained.

EXAMPLE 2

A mercerized bleached cotton sateen is padded with a dye bath containing 25 g/l of C.I. Reactive Yellow 87

100 g/l of sodium waterglass of 36° Bé, having a $Na_2O:SiO_2$ weight ratio of 1:2.5

1 g/l of borax, and 10 g/l of sodium bicarbonate and then is squeezed to 65% residual moisture. The resulting substrate is stored at 25° for 4 hours. An even deep yellow tone is obtained.

EXAMPLE 3

Rayon staple fibre is padded for 3 hours to give a 67% pick-up of a dye bath containing 25 g/l of C.I. Reactive Yellow 125

100 g/l of sodium waterglass of 36° Bé, having a $Na_2O:SiO_2$ weight ratio of 1:2.5

1 g/l of borax, and 10 g/l of sodium bicarbonate

The resulting substrate is then stored at 25° for 4 hours. The dyed substrate has a brilliant yellow tone.

Similar results are obtained when the sodium bicarbonate is omitted from the above described dyebaths.

EXAMPLE 4

330 g of sodium waterglass of 36°-38° Bé having a $Na_2O:SiO_2$ weight ratio of 1:2.5, and 10 g of borax are dissolved with stirring at 100° in 1 liter of water. The resulting mixture is then cooled to room temperature and diluted to 10 liters. 100 g of sodium bicarbonate are added with stirring to this solution. The alkaline solution thus obtained can be used as a fixing liquor or, after addition of the desired dyestuffs and if necessary of the usual additives, as a dyebath or a printing paste.

What I claim is:

1. In a process wherein a substrate comprising cellulosic fibers is dyed or printed with a reactive dyestuff and then subjected to a treatment under alkaline conditions to effect fixation of the dyestuff, the improvement whereby the alkaline conditions are achieved by treating the substrate with a dyeing liquor or printing paste having present therein both the reactive dyestuff and an aqueous solution of an alkaline system having a pH of 9 to 13 and consisting essentially of 2.5 to 110 g/l of alkali metal silicate 0.1 to 10 g/l of alkali metal borate, 0 to 100 g/l of alkali metal bicarbonate and 0 to 100 g/l of alkali metal carbonate.

2. A process according to claim 1, wherein the substrate is padded or printed at a temperature of from 5° to 40° C. with a dyeing liquor or a printing paste at a pH of from 10 to 12.7 containing the alkaline system.

3. A process according to claim 2, wherein the fixation of the reactive dyestuff is effected by storing the treated substrate at a temperature of from 5° to 40° C. for 2 to 24 hours.

4. A process according to claim 2 wherein the substrate is printed with a printing paste containing the alkaline system.

5. A process according to claim 2, wherein the alkali metal silicate is soda waterglass of 30°-60° Bé having a $Na_2O:SiO_2$ weight ratio of from 1:1.5 to 1:3.

6. A process according to claim 2, wherein alkali metal borate is borax ($Na_2B_4O_7,10H_2O$).

7. A process according to claim 2, wherein the alkali metal silicate is sodium silicate and the alkali metal borate is borax and wherein the dry weight ratio of sodium silicate to borax is from 1100:1 to 1:4.

8. A process according to claim 2, wherein the alkaline system comprises, in addition to the alkali metal silicate and borate, an alkali metal bicarbonate and/or an alkali metal carbonate.

9. A process according to claim 2 wherein the dyeing liquor or printing paste contains 12.5 to 54 g/l of alkali metal silicate, 0.5 to 3 g/l of alkali metal borate, 1 to 50 g/l alkali metal bicarbonate and 0 to 50 g/l of alkali metal carbonate.

10. A process according to claim 9 wherein the alkali metal silicate is soda waterglass of 30°-45° Bé having a $Na_2O:SiO_2$ weight ratio of 1:2 to 1:3 and the alkali metal borate is borax and the dry weight ratio of soda waterglass to borax is from 68:1 to 18:1.

11. A process according to claim 2 wherein the alkali metal silicate is soda waterglass of 30°-60° Be having a $Na_2O:SiO_2$ weight ratio of from 1:1.5 to 1:3 and the alkali metal borate is borax.

12. A process according to claim 11 wherein the dry weight ratio of alkali metal silicate to alkali metal borate is 110:1 to 4:1.

13. A process according to claim 2 wherein the reactive dyestuff has at least one reactive group selected from vinylsulphonyl, sulphatoethylsulphonyl, sulphatoethylsulphonamido, thiosulphatoethylsulphonamido, sulphatoethylsulphonacrylamido, methyltaurinoethylsulphonyl, acrylamido, α-haloacrylamido, chloropropylamido, sulphatopropylamido, haloaceticacidamido, mono- and di-halo-1,3,5-triazinyl, trichloropyrimidinyl, mono-chlorodifluoropyrimidinyl, methylsulphonylchloromethyl-pyrimidinyl, dichloroquinoxalinyl,dichlorophtalazinyl, benzochlorothiazolyl, dichloropyridazonyl, dichloropyrazinyl, chloroacetyl, β-chloropropionyl, α,β-dibromopropionyl and α,β-dichloropropionyl radicals.

14. A process according to claim 2 in which the treatment under alkaline conditions to effect fixation of the dyestuff is carried out at a temperature of from 5° to 150° C.

15. A process according to claim 14 wherein the substrate is padded or printed with a dyeing liquor or printing paste containing the reactive dyestuff and the alkaline system and the reactive dyestuff is subsequently fixed by storing the impregnated or printed substrate for 2 to 24 hours at a temperature of from 5° to 40° C.

16. A process according to claim 15 wherein the reactive dyestuff is a cold dyeing reactive dyestuff having a reactive group selected from the group consisting of mono- and di-halo-1,3,5-triazinyl, trichloropyrimidinyl and monochlorodifluoropyrimidinyl.

17. An aqueous dye liquor or printing paste having a pH of 10-13 comprising a reactive dyestuff and an alkaline system consisting essentially of from 2.5 to 110 g/l of an alkali metal silicate, from 0.1 to 10 g/l of an alkali metal borate, from 0 to 100 g/l of an alkali metal bicarbonate and from 0 to 100 g/l of an alkali metal carbonate.

18. An aqueous dye liquor or printing paste having a pH of 10–13 comprising a reactive dyestuff and an alkaline composition consisting essentially of water, sodium silicate having a $Na_2O:SiO_2$ weight ratio of from 1:1.5 to 1:3, and borax, the dry weight ratio of sodium silicate to borax being from 110:1 to 4:1.

19. An aqueous dye liquor or printing paste according to claim 18 in which the sodium silicate has a $Na_2O:SiO_2$ weight ratio of from 1:2 to 1:3.

20. An aqueous dye liquor or printing paste according to claim 19 in which the dry weight ratio of sodium silicate to borax is in the range 68:1 to 18:1.

* * * * *